US005476419A

United States Patent [19]

Meurer

[11] Patent Number: 5,476,419

[45] Date of Patent: Dec. 19, 1995

[54] THERMALLY ACTUATED HEATING/COOLING AIR CHANGEOVER DEFLECTOR STRUCTURE FOR A CEILING DIFFUSER

[75] Inventor: Henry J. Meurer, Plano, Tex.

[73] Assignee: Eljer Industries, Dallas, Tex.

[21] Appl. No.: 339,809

[22] Filed: Nov. 15, 1994

[51] Int. Cl.[6] ..... F24F 11/053; F24F 13/068

[52] U.S. Cl. ..... 454/258; 236/49.5; 236/101 D; 454/297

[58] Field of Search ..... 236/49.5, 101 D; 454/258, 297, 298

[56] References Cited

U.S. PATENT DOCUMENTS

| | | | |
|---|---|---|---|
| Re. 25,216 | 8/1962 | Kennedy . | |
| 2,117,529 | 5/1938 | Wile et al. . | |
| 2,396,025 | 3/1946 | Seid . | |
| 2,403,291 | 7/1946 | Kurth . | |
| 2,407,284 | 9/1946 | Kennedy . | |
| 3,068,776 | 12/1962 | Day | 454/258 X |
| 3,174,422 | 3/1965 | Banko et al. . | |
| 4,020,752 | 5/1977 | Stephan | 454/297 |
| 4,231,513 | 11/1980 | Vance et al. . | |
| 4,515,069 | 5/1985 | Kline et al. . | |
| 4,535,932 | 8/1985 | Herb . | |
| 4,537,347 | 8/1985 | Noll et al. . | |
| 4,625,629 | 12/1986 | Bryans . | |
| 4,699,314 | 10/1987 | Faurie | 236/49.5 |
| 5,103,869 | 4/1992 | Kimura et al. | 454/297 X |
| 5,346,130 | 9/1994 | Rademaker | 454/297 X |

*Primary Examiner*—Harold Joyce

*Attorney, Agent, or Firm*—Catherine E. Bracken; J. Richard Konneker; Michael S. Bush

[57] ABSTRACT

A thermally actuated deflector structure for automatically varying the air discharge pattern of a ceiling diffuser in response to a sensed change in the temperature of air being delivered to the diffuser includes a multi-bladed damper assembly positioned over a central outlet portion of the diffuser and having a frame portion secured to the diffuser. The blades in the damper assembly are drivable between a cooling orientation in which they block the central diffuser portion and preclude supply air flow downwardly therethrough, and a heating orientation in which they uncover the central diffuser portion and permit supply air flow downwardly therethrough. A coiled bimetallic actuating strip is positioned above the damper assembly and has an inner end anchored to the damper frame, and an outer end secured to a drive member linked to the damper blades. A change in the temperature of air being delivered to the diffuser is sensed by the strip which, by thermally actuated deflection of its outer end, drives the damper blades to their heating orientation when heated air is being delivered to the diffuser, and drives the damper blades to their cooling orientation when cooled air is being delivered to the diffuser.

14 Claims, 2 Drawing Sheets

THERMALLY ACTUATED HEATING/COOLING AIR CHANGEOVER DEFLECTOR STRUCTURE FOR A CEILING DIFFUSER

BACKGROUND OF THE INVENTION

The present invention generally relates to air diffusers and, in a preferred embodiment thereof, more particularly relates to an air diffuser incorporating therein apparatus for automatically changing its air delivery pattern in response to changes in temperature of air being supplied to the diffuser.

Heating, ventilating and air conditioning (HVAC) units are conventionally utilized to supply heated or cooled air to the various rooms of a building as needed by the rooms to keep them at a desired temperature. The heated or cooled air is typically delivered to the rooms via a supply ductwork system interconnected between the HVAC unit(s) and a series of ceiling supply diffusers in the rooms to be maintained at a predetermined temperature. The supply air delivered to the rooms through the supply ductwork system is forced downwardly into the rooms through their associated ceiling supply diffusers, and is then flowed back to the HVAC unit(s), typically via a return ductwork system, to be reheated or recooled as necessary and flowed back into the rooms.

As is well known in the HVAC industry, the most effective manner of distributing air from ceiling diffusers during cooling is to direct the air in a generally horizontal flow across the ceiling of the room by employing what is known in the industry as the "Coanda effect." A stream of air discharged from a ceiling diffuser at an angle less than approximately 35 to 40 degrees with respect to the ceiling will tend to create a partial vacuum between the air and the ceiling and thereby cause the discharged air stream to remain in contact with or hug the ceiling as a result of the Coanda effect. Cool air, therefore, can be distributed over a substantial area of the ceiling by employing the Coanda effect before the cool air discharged from the ceiling diffuser begins to sink down into the room to cool the entire volume of the room.

On the other hand, the best efficiency in connection with the distribution of hot air from a ceiling diffuser is for the air to be discharged from the diffuser in a generally vertically oriented stream. The vertical flow component imparted to the heated air overcomes the natural buoyancy of the heated discharge air to serve the lower strata of the room with heated air and to thereby achieve a proper mixing of the heated air with the room air. Because the discharged air flows through the occupied space before mixing is complete, drafts may be directed at the occupants. However, most people do not perceive warm drafts as uncomfortable.

To avoid the considerable inconvenience of having to manually adjust the diffusers in a given HVAC system each time a heating/cooling changeover is required by the sensed room temperatures, various types of ceiling diffusers have been previously proposed in which their air discharge patterns are automatically changed in response to a sensed change in the temperature of air being delivered thereto by an HVAC unit. Various motorized and non-motorized structures have been associated with ceiling diffusers to effect this desired change in air discharge patterning in response to a sensed changeover from heating air to cooling air, and vice versa, being supplied to the diffuser.

However, conventional heating/cooling air patterning changeover apparatus used in conjunction with ceiling diffusers has tended to be undesirably expensive, complex, unreliable and/or relatively difficult to install. Accordingly, it is an object of the present invention to provide a ceiling diffuser with improved heating/cooling air patterning changeover apparatus that eliminates or at least substantially eliminates these problems, limitations and disadvantages associated with conventional thermal changeover apparatus.

SUMMARY OF THE INVENTION

In carrying out principles of the present invention, in accordance with a preferred embodiment thereof, ceiling supply air diffuser apparatus is provided that comprises a bottom side portion having central and peripheral portions through heating or cooling air may be downwardly flowed, and thermally actuatable heating/cooling changeover means for blocking the central portion in response to downward flow through the bottom side portion of air at a first predetermined temperature, and for uncovering the central portion in response to downward flow through the bottom side portion of air at a second predetermined temperature greater than the first predetermined temperature.

The thermally actuatable heating/cooling changeover means include damper means carried above the central portion and being drivable between open and closed orientations; and a bimetallic strip member, preferably disposed in a coiled orientation, that is thermally deflectable to drive the damper means between their open and closed orientations. The bimetallic strip member has a first end supported in a fixed relationship with the bottom side portion of the diffuser apparatus, and a movable second end drivingly connected to the damper means.

In a preferred embodiment of the diffuser apparatus, its bottom side portion is a perforated diffuser plate member, and the diffuser apparatus further includes a dome structure secured to the peripheral edge of the plate member and defining an air receiving plenum disposed over the top side of the plate member. The dome structure has a central top side opening disposed over a central portion of the perforated diffuser plate member. Alternatively, the bottom side portion of the diffuser apparatus may be a diffuser structure having a configuration other the representatively illustrated perforated plate.

The thermally actuatable heating/cooling changeover means include a frame portion secured to the top side of the perforated diffuser plate member over a central portion thereof, and a plurality of damper blades carried on an upper side of the frame portion for pivotal movement relative thereto between a closed position in which they block air flow downwardly through the frame portion and an open position in which they permit air flow downwardly through the frame portion. The damper blades are linked for conjoint pivotal movement between their open and closed positions by a movable linking structure.

The bimetallic strip member is disposed above the damper blades, is coiled about an axis perpendicular to the perforated diffuser plate, and has its outer end received in a slot formed in the linking structure. The inner end of the coiled bimetallic strip member is fixedly secured to a support member which, in turn, is anchored to the frame portion.

When heating air is being forced downwardly through the diffuser apparatus, the outer end of the coiled bimetallic strip horizontally shifts the linking structure in a manner opening the damper blades and causing the heated air discharged from the diffuser to be substantially vertically directed. However, when lower temperature cooling air is being forced downwardly through the diffuser apparatus, the outer end of the coiled bimetallic strip horizontally shifts the linking structure in an opposite direction to close the damper blades. The closed damper blades, which now block the central portion of the perforated diffuser plate member, serve as a baffle to horizontally deflect a portion of the cooling air within the dome. This horizontal cooling air deflection within the dome gives the cooling air discharged from the diffuser apparatus a desirable horizontal velocity component that permits the discharged cooling air to hug the ceiling to advantageously spread out its delivery pattern. As will be appreciated by those of skill in this particular art, the bimetallic strip may be constructed to "change over" the diffuser apparatus between its heating and cooling air discharge patterns at predetermined heating and cooling air temperatures.

DETAILED DESCRIPTION

Figure 1:
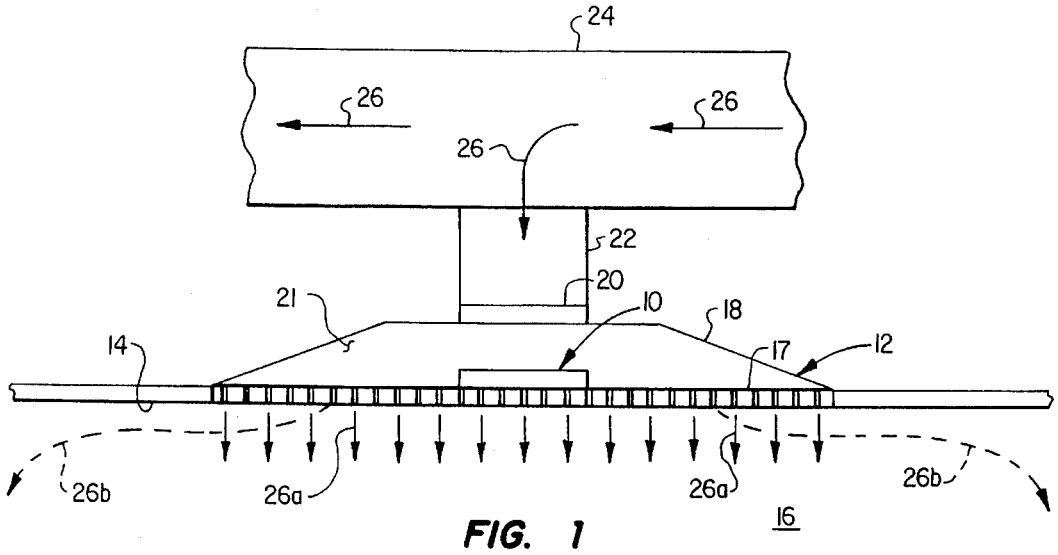
FIG. 1 is a simplified schematic side elevational view of a representative ceiling supply air diffuser incorporating therein a thermally actuated heating/cooling changeover deflector structure embodying principles of the present invention.
Figure 2:
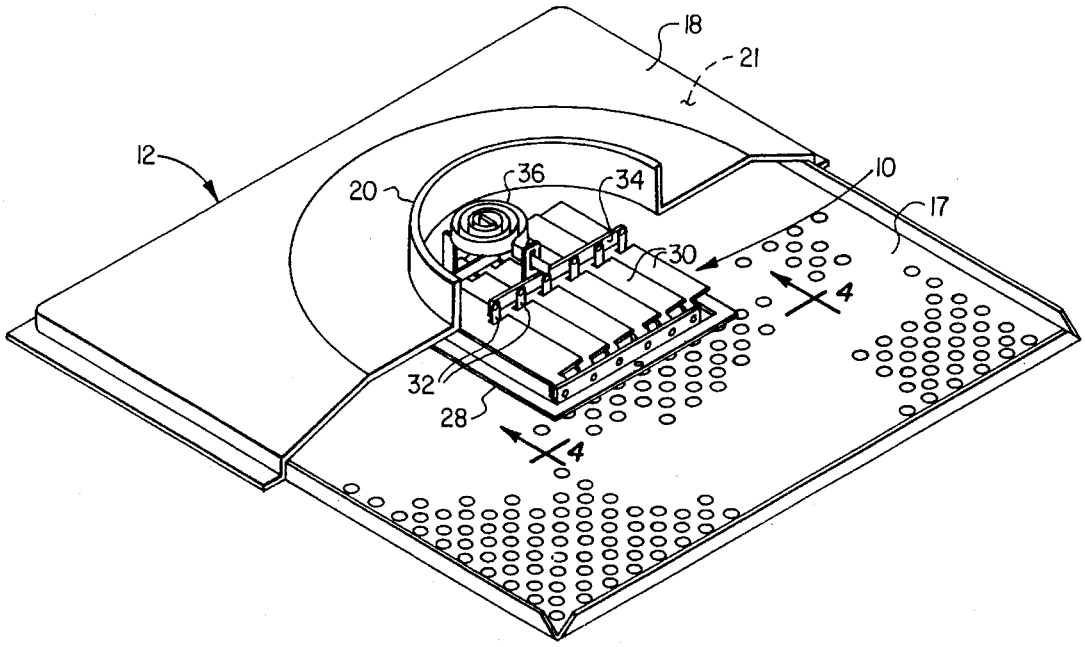
FIG. 2 is an enlarged scale, partially cut away perspective view of the ceiling diffuser.

Referring initially to FIGS. 1 and 2 of the drawings, the present invention provides a thermally actuated deflector structure 10 that is used in conjunction with supply air diffuser apparatus 12 mounted in a ceiling 14 of a conditioned space 16 (such as a room in a building) that is to be heated or cooled as needed. Diffuser apparatus 12 representatively includes a rectangular perforated diffuser plate member 17 that defines a bottom outlet side portion of the diffuser apparatus. The bottom outlet side portion of the diffuser apparatus 12 may alternatively be a diffuser structure of a type other than a perforated plate, and the representatively illustrated rectangular perforated plate may have another configuration such as square or round if desired. Diffuser apparatus 12 further includes a hollow, upwardly and horizontally inwardly tapered air delivery dome 18 disposed above the diffuser plate member 17 and secured around its outer peripheral edge. Air delivery dome 18 has a circular top inlet 20 and defines an air delivery plenum 21 disposed above the top side of the perforated diffuser plate member 17.

Inlet 20 is connected to the bottom end of a round branch supply duct 22 having a top end connected to and communicating with the interior of a main air supply duct 24. The supply duct 24 is connected to a suitable HVAC unit (not shown) operative to force conditioned air 26 therethrough. Depending on the requirements of the conditioned space 16, the air 26 may be either heated air or cooled air.

The deflector structure 10 is mounted atop a central portion of the perforated diffuser plate member 17, within the plenum 21, directly beneath the dome inlet 20 in a downwardly spaced relationship therewith. In a manner subsequently described, the deflector structure 10 is movable between open and closed positions in respective response to the flow of heated or cooled air downwardly through the dome 18. With the deflector structure 10 in its open or "heating" position, heated air **26*a* flowing downwardly through the dome 18 is vertically discharged downwardly through the open deflector structure 10, the central portion of the perforated diffuser plate member 17 directly beneath the deflector structure 10, and the portion of the diffuser 12 outwardly surrounding the deflector structure 10, generally perpendicular to the ceiling 14**.

However, when cooled air **26*b* is flowing downwardly through the dome 18, the deflector structure 10 automatically closes, thereby blocking off a central portion of the perforated diffuser plate member 17. This causes the cooled air 26*b* to be horizontally deflected within the plenum 21 and correspondingly causes the cooled air 26*b* exiting the diffuser 12 to have a substantial horizontal velocity component. Due to the Coanda effect, the discharged cooled air 26*b* "hugs" the ceiling 14 and causes the cooled air 26*b* to spread outwardly away from the diffuser 12 before falling toward the floor of the conditioned space 16. Thus, generally optimum air distribution patterns are achieved for both heating and cooling cycles of the HVAC unit without the need to manually adjust the outlet air pattern of the diffuser 12** each time a heating/cooling changeover occurs.

Figure 3:
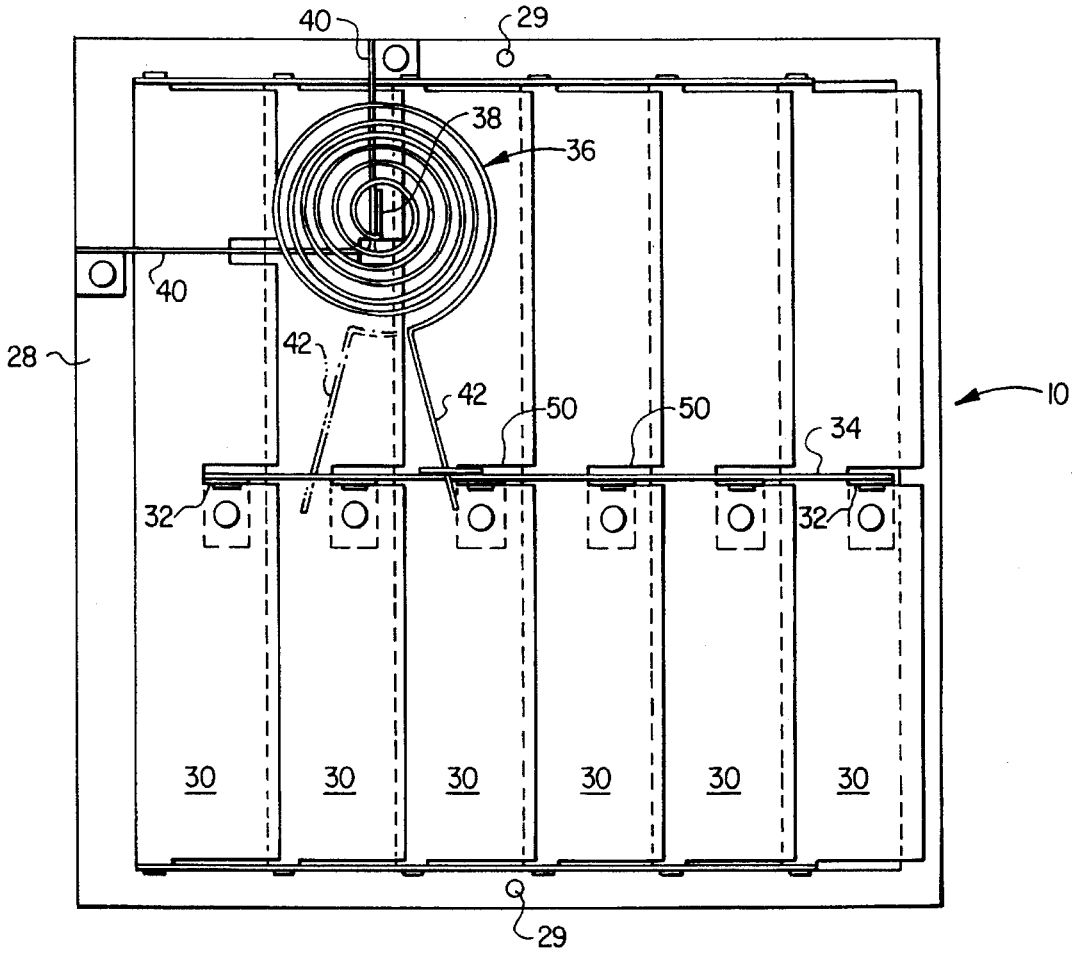
FIG. 3 is an enlarged scale top plan view of the changeover deflector structure shown in FIG. 2.
Figure 4:
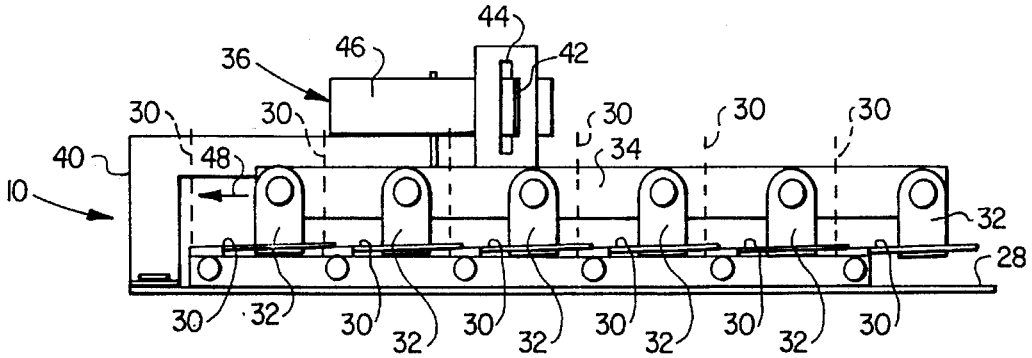
FIG. 4 in an enlarged scale side elevational view of the changeover deflector structure taken generally along line 4—4 of FIG. 2.

Turning now to FIGS. 2–4, the deflector structure 10 includes a rectangular bottom side frame 28 secured to the top side of the perforated diffuser plate member 17, over a central portion thereof, by suitable fasteners 29 and upon which a series of damper blades 30 are carried for pivotal movement relative to the frame between a closed position (shown in solid lines in FIG. 4) in which the blades are horizontal and block a central portion of the perforated diffuser plate member 17, and an open position (shown in dotted lines in FIG. 4) in which the blades 30 are vertical and unblock the central diffuser plate portion. The horizontal, closed position of the damper blades 30 represents the "cooling" orientation of the deflector structure 10, while the vertical, open position of the damper blades 30 represents the "heating" position of the deflector structure 10.

Central longitudinal portions of the damper blades 30 are linked, via brackets 32, to an elongated driving member in the form of a tie bar 34 which is longitudinally movable in leftward and rightward directions relative to the frame 28 to effect the pivotal movement of the blades 30 between their open and closed positions. To automatically move the tie bar 34 in response to changes in temperature of the supply air being discharged through the diffuser 12, a spirally coiled, thermally deflectable bimetallic strip member 36 is utilized.

The bimetallic strip 36 is horizontally positioned above the damper blades 30, is coiled about an axis perpendicular to the perforated diffuser plate 17, and has an inner end 38 anchored to a generally L-shaped mounting bracket 40 secured at opposite end portions thereof to the top side of an upper left corner portion of the frame 28 as viewed in FIG. 3. The outer end 42 of the strip 36 extends generally radially outwardly from the balance of the coiled strip 36 and is slidingly received in a vertical slot 44 formed in a bracket 46 anchored to and projecting upwardly from a horizontally central portion of the tie bar 34.

When cooling air **26*b* is being flowed downwardly through the duct 22 and outwardly through the diffuser 12, the outer end 42 of the bimetallic strip 36 is in its FIG. 3 solid line position, the tie bar 34 is rightly shifted to its orientation illustrated in FIGS. 3 and 4, and the damper blades 30** are held in their indicated solid line closed orientations. However, when higher temperature heating air 26*a* is being flowed downwardly through the duct 22 and outwardly through the diffuser 12, the increase in supply air temperature thermally deforms the bimetallic strip 36 in a manner causing its outer end to pivot in a clockwise direction, as indicated in FIG. 3, from its solid line position to its dotted line position. This, in turn, leftwardly drives the tie bar 34 (as indicated by the arrow 48 in FIG. 4), thereby upwardly pivoting the damper blades 30 to their vertical, dotted line open orientations. In a reverse manner, the damper blades 30 are pivoted back to their horizontal, solid line closed orientation when a changeover is made from heated supply air 26*a* to cooled supply air 26*b*.

The use of the bimetallic element 36, mechanically coupled between the mounting bracket 40 and the tie bar bracket 46, to automatically open and close the damper blades 30 in response to a change between heating and cooling temperatures of the supply air being delivered to the conditioned space 16 via the diffuser 12 provides a simple, inexpensive and quite reliable method of automatically adjusting the delivery pattern of air being discharged from the diffuser 12 in response to a heating/cooling changeover of the HVAC unit supplying air to the diffuser.

The foregoing detailed description is to be clearly understood as being given by way of illustration and example only, the spirit and scope of the present invention being limited solely by the appended claims.

What is claimed is:

1. Heating/cooling changeover air deflector apparatus for use in conjunction with a ceiling diffuser having a horizontally positionable outlet portion, the outlet portion having a top side, and central and peripheral sections through which air supplied to the ceiling diffuser may be discharged, said heating/cooling changeover air deflector apparatus comprising:

a frame portion securable to the top side of the ceiling diffuser outlet portion over the central section thereof;

damper means supported on said frame portion and being drivable between a closed orientation in which said damper means block said frame portion and substantially preclude air flow therethrough, and an open orientation in which said damper means unblock said frame portion and permit air flow therethrough; and drive means for sensing an air temperature adjacent said damper means and responsively driving said damper means to said open orientation when said air temperature is of a first predetermined magnitude, and driving said damper means to said closed orientation when said air temperature is of a second predetermined magnitude less than said first predetermined magnitude, said drive means including a thermally deflectable bimetallic strip member having a first end portion fixedly associated with said frame portion and a second end drivingly connected to said damper means.

2. The heating/cooling changeover air deflector apparatus of claim 1 wherein said bimetallic strip member is in a coiled configuration.

3. The heating/cooling changeover air deflector apparatus of claim 2 wherein:

said frame portion has a top side, said damper means include:

a plurality of damper blades having upper sides and being supported on said frame portion for pivotal movement relative thereto between first positions in which the widths of said damper blades are generally parallel to said frame portion, and a second position in which the widths of said damper blades are generally perpendicular to said frame portion, and a linking structure positioned above and connected to said damper blades, said linking structure being shiftable relative to said frame portion to simultaneously move said damper blades from either of said first and second positions to the other of said first and second positions, and the coiled bimetallic strip member is positioned above said damper blades, and said second end portion of the coiled bimetallic strip member is an outer end portion thereof and is drivingly secured to said linking structure.

4. The heating/cooling changeover air deflector apparatus of claim 3 wherein:

said first end portion of the coiled bimetallic strip member is an inner end portion thereof, said air deflector apparatus further comprises an elongated support member having opposite end portions anchored to spaced apart sections of said frame portion, and a longitudinally intermediate portion positioned above said damper blades, and said inner end portion of the coiled bimetallic strip member is anchored to said longitudinally intermediate portion of said elongated support member.

5. The heating/cooling changeover air deflector apparatus of claim 3 wherein:

said linking structure has a slot therein, and said outer end portion of the coiled bimetallic strip member is received in said slot.

6. Ceiling supply air diffuser apparatus comprising:

a ceiling supply air diffuser having a hollow body with an inlet for receiving a flow of heating or cooling air from a source thereof, and a bottom side portion having central and peripheral portions with openings therein through which the received heating or cooling air may be downwardly flowed; and heating/cooling changeover air deflector apparatus including:

a frame portion secured to and overlying said central portion of said bottom side portion of said hollow ceiling supply air diffuser body, damper means supported on said frame portion and being drivable between a closed orientation in which said damper means block said frame portion and substantially preclude air flow therethrough, and an open orientation in which said damper means unblock said frame portion and permit air flow therethrough; and drive means for sensing an air temperature adjacent said damper means and responsively driving said damper means to said open orientation when said air temperature is of a first predetermined magnitude, and driving said damper means to said closed orientation when said air temperature is of a second predetermined magnitude less than said first predetermined magnitude, said drive means including a thermally deflectable bimetallic strip member having a first end portion fixedly associated with said frame portion and a second end drivingly connected to said damper means.

7. The ceiling supply air diffuser apparatus of claim 6 wherein:

said bottom side portion is a perforated plate member.

8. The ceiling supply air diffuser apparatus of claim 6 wherein:

said bimetallic strip member is in a coiled configuration.

9. The ceiling supply air diffuser apparatus of claim 6 wherein:

said bottom side portion of said hollow ceiling supply air diffuser body has a peripheral edge, and said hollow ceiling supply air diffuser body further comprises an air delivery dome structure secured to said peripheral edge and defining an air receiving plenum disposed above said bottom side portion, said dome structure having a top side opening disposed above said heating/cooling changeover means and to which a supply air duct may be connected to flow air into said air receiving plenum.

10. Ceiling supply air diffuser apparatus comprising:

a diffuser plate member having a top side, a peripheral edge portion, a generally central first perforated portion spaced inwardly apart from said peripheral edge portion, and a second perforated portion disposed between said peripheral edge portion and said first perforated portion;

an air delivery dome structure secured to said peripheral edge portion and defining an air receiving plenum disposed above said top side of said diffuser plate member, said air delivery dome structure having a top side opening spaced upwardly apart from and facing said first perforated portion of said diffuser plate member and to which a supply air duct may be secured to flow heating and cooling air into said air receiving plenum for discharge downwardly through said diffuser plate member; and thermally actuatable heating/cooling changeover means for blocking said first perforated portion of said diffuser plate member in response to a flow of cooling air into said air receiving plenum, and for unblocking said first perforated portion of said diffuser plate member in response to a flow of heating air into said air receiving plenum, said thermally actuatable heating/cooling changeover means including:

damper means supported on the top side of said diffuser plate member, within said air receiving plenum and over said first perforated portion, and being drivable between open and closed orientations, and a coiled bimetallic strip member disposed within said air delivery plenum and being thermally deflectable to drive said damper means between said open and closed orientations thereof, said coiled bimetallic strip having a first end supported in a fixed relationship with said diffuser plate member and being drivingly connected to said damper means, said damper means including:

a frame portion secured to the top side of said diffuser plate member and extending generally along the juncture between said first and second perforated portions thereof, a plurality of damper blades having upper sides and being supported on said frame portion for pivotal movement relative thereto between first positions in which the widths of said damper blades are generally parallel to said diffuser plate member, and a second position in which the widths of said damper blades are generally perpendicular to said diffuser plate member, and a linking structure positioned above and connected to said damper blades, said linking structure being shiftable relative to said frame portion to simultaneously move said damper blades from either of said first and second positions to the other of said first and second positions, and said second end of the coiled bimetallic strip member being drivingly connected to said linking structure.

11. The ceiling supply air diffuser apparatus of claim 10 wherein:

the coiled bimetallic strip member is positioned above said damper blades.

12. The ceiling supply air diffuser apparatus of claim 11 wherein:

said first end of the coiled bimetallic strip member is an inner end thereof, said second end of the coiled bimetallic strip member is an outer end thereof, said ceiling supply air diffuser apparatus further comprises an elongated support member having opposite end portions anchored to spaced apart sections of said frame portion, and a longitudinally intermediate portion positioned above said damper blades, and said inner end of the coiled bimetallic strip member is anchored to said longitudinally intermediate portion of said elongated support member.

13. The ceiling supply air diffuser apparatus of claim 12 wherein:

said linking structure has a slot therein, and said outer end of the coiled bimetallic strip member is received in said slot.

14. Ceiling supply air diffuser apparatus comprising:

a diffuser plate member having a top side, a peripheral edge portion, a generally central first perforated portion spaced inwardly apart from said peripheral edge portions, and a second perforated portion disposed between said peripheral edge portion and said first perforated portion;

an air delivery dome structure secured to said peripheral edge portion and defining an air receiving plenum disposed above said top side of said diffuser plate member, said air delivery dome structure having a top side opening spaced upwardly apart from and facing said first perforated portion of said diffuser plate member and to which a supply air duct may be secured to flow heating and cooling air into said air receiving plenum for discharge downwardly through said diffuser plate member; and thermally actuatable heating/cooling changeover means for blocking said first perforated portion of said diffuser plate member in response to a flow of cooling air into said air receiving plenum, and for unblocking said first perforated portion of said diffuser plate member in response to a flow of heating air into said air receiving plenum, said thermally actuatable heating/cooling changeover means including:

damper means supported on the top side of said diffuser plate member, within said air receiving plenum and over said first perforated portion, and being drivable between open and closed orientations, and a coiled bimetallic strip member disposed within said air delivery plenum and being thermally deflectable to drive said damper means between said open closed orientations thereof, said coiled bimetallic strip having a first end supported in a fixed relationship with said diffuser plate member, and a second end being movable relative to said diffuser plate member and being drivingly connected to said damper means, said bimetallic strip member being coiled about an axis extending generally perpendicularly to said diffuser plate member.

* * * * *

UNITED STATES PATENT AND TRADEMARK OFFICE

CERTIFICATE OF CORRECTION

PATENT NO. : 5,476,419

DATED : Dec. 19, 1995

INVENTOR(S) : Henry J. Meurer

It is certified that error appears in the above-identified patent and that said Letters Patent is hereby corrected as shown below:

On title page, item [73], change "Eljer Industries, Dallas, Tex." to read --Eljer Manufacturing, Incorporated, Dallas, Tex.--.

Signed and Sealed this

Tenth Day of August, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,476,419

DATED : December 19, 1995

INVENTOR(S) : Henry J. Meurer

It is certified that error appears in the above-indentified patent and that said Letters Patent is hereby corrected as shown below:

On the title page: Item [73]
assignee "Eljer Industries, Dallas, Tex." should read
--Eljer Manufacturing, Incorporated, Dallas, Tex.--.

Signed and Sealed this

Seventeenth Day of August, 1999

*Attest:*

*Attesting Officer*

Q. TODD DICKINSON

*Acting Commissioner of Patents and Trademarks*